US011808234B2

(12) United States Patent
Doi et al.

(10) Patent No.: US 11,808,234 B2
(45) Date of Patent: Nov. 7, 2023

(54) COVER FOR INTERNAL COMBUSTION ENGINE

(71) Applicant: TOYOTA BOSHOKU KABUSHIKI KAISHA, Aichi-ken (JP)

(72) Inventors: Kensuke Doi, Obu (JP); Yoji Horiuchi, Kariya (JP)

(73) Assignee: TOYOTA BOSHOKU KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 17/925,370

(22) PCT Filed: Jun. 29, 2021

(86) PCT No.: PCT/JP2021/024624
§ 371 (c)(1),
(2) Date: Nov. 15, 2022

(87) PCT Pub. No.: WO2022/024639
PCT Pub. Date: Feb. 3, 2022

(65) Prior Publication Data

US 2023/0193850 A1 Jun. 22, 2023

(30) Foreign Application Priority Data

Jul. 27, 2020 (JP) ..... 2020-126502

(51) Int. Cl.
*F02F 7/00* (2006.01)
*F02B 67/06* (2006.01)

(52) U.S. Cl.
CPC ..... *F02F 7/0068* (2013.01); *F02B 67/06* (2013.01)

(58) Field of Classification Search
CPC ..... F02F 7/0068; F02F 7/008; F02F 7/0085; F02F 1/24; F02B 67/06
See application file for complete search history.

(56) References Cited

U.S. PATENT DOCUMENTS 5,645,024 A * 7/1997 Allen ..... F02F 7/0073 123/90.31
6,752,119 B2 * 6/2004 Coleman ..... F02F 7/0073 123/195 C
2016/0298766 A1 * 10/2016 Kawai ..... F16J 15/3268

FOREIGN PATENT DOCUMENTS

JP 2010-031666 2/2010
JP 2015-102018 6/2015

OTHER PUBLICATIONS

Official communication cited in International Patent Application No. PCT/JP2021/024624, dated Sep. 7, 2021, along with English translation thereof.

* cited by examiner

*Primary Examiner* — Syed O Hasan
(74) *Attorney, Agent, or Firm* — GREENBLUM & BERNSTEIN, P.L.C.

(57) ABSTRACT

A chain cover includes a first member, which is made of a hard plastic, and a second member, which is made of a material different from the hard plastic. The first member includes a back face, which faces an engine main body. The second member is joined to the first member. Only the back face of the first member includes a groove, which receives a seal member. The seal member provides a seal between the first member and the engine main body.

5 Claims, 4 Drawing Sheets

COVER FOR INTERNAL COMBUSTION ENGINE

TECHNICAL FIELD

The present disclosure relates to a cover for an internal combustion engine that is attached to an engine main body and covers a timing chain or a timing belt.

BACKGROUND ART

Patent Literature 1 discloses a plastic timing chain cover (hereinafter, referred to as chain cover) that is attached to the engine main body of an internal combustion engine. The chain cover has a through-hole into which a crankshaft is inserted. The chain cover also has multiple through-holes in a peripheral portion. These through-holes receive bolts that fasten the chain cover to the engine main body.

The chain cover has a groove portion in the surface facing the engine main body. The groove portion extends along the periphery of the chain cover.

A loop-shaped seal member is fitted in the groove portion over the entire periphery to provide a seal between the engine main body and the chain cover.

CITATION LIST

Patent Literature

Patent Literature 1: Japanese Laid-Open Patent Publication No. 2015-102018

SUMMARY OF INVENTION

Technical Problem

There is a demand for a chain cover that includes members made of different materials in order to, for example, partially improving the dimensional accuracy of the chain cover. However, since the above-described groove portion extends across two or more members, steps are likely to form at boundaries between the members. This is likely to hinder close contact between the seal member and the groove portion, and thus may reduce the sealing performance.

An objective of the present disclosure is to provide a cover for an internal combustion engine that is capable of maintaining close contact between a seal member and a groove portion.

Solution to Problem

In order to achieve the foregoing objective, a cover for an internal combustion engine is provided. The cover is attached to an engine main body and covers a timing chain or a timing belt. The cover includes a first member and a second member. The first member is made of a hard plastic and includes a facing surface. The facing surface faces the engine main body. The second member is made of a material different from the hard plastic and is joined to the first member. A groove portion is provided only in the facing surface of the first member. A seal member is fitted in the groove portion to provide a seal between the first member and the engine main body.

With this configuration, the groove portion includes no boundary between members unlike a case in which the groove portion extends across the first member and the second member. This prevents the groove portion from having a step on the inner surface. The close contact between the seal member and the groove portion is thus maintained.

DESCRIPTION OF EMBODIMENTS

A cover for an internal combustion engine according to an embodiment will now be described with reference to FIGS. 1 to 4. In the present embodiment, a timing chain cover (hereinafter, referred to as a chain cover) of the present disclosure is attached to a reciprocating (piston-type) internal combustion engine mounted on a vehicle.

Figure 1:
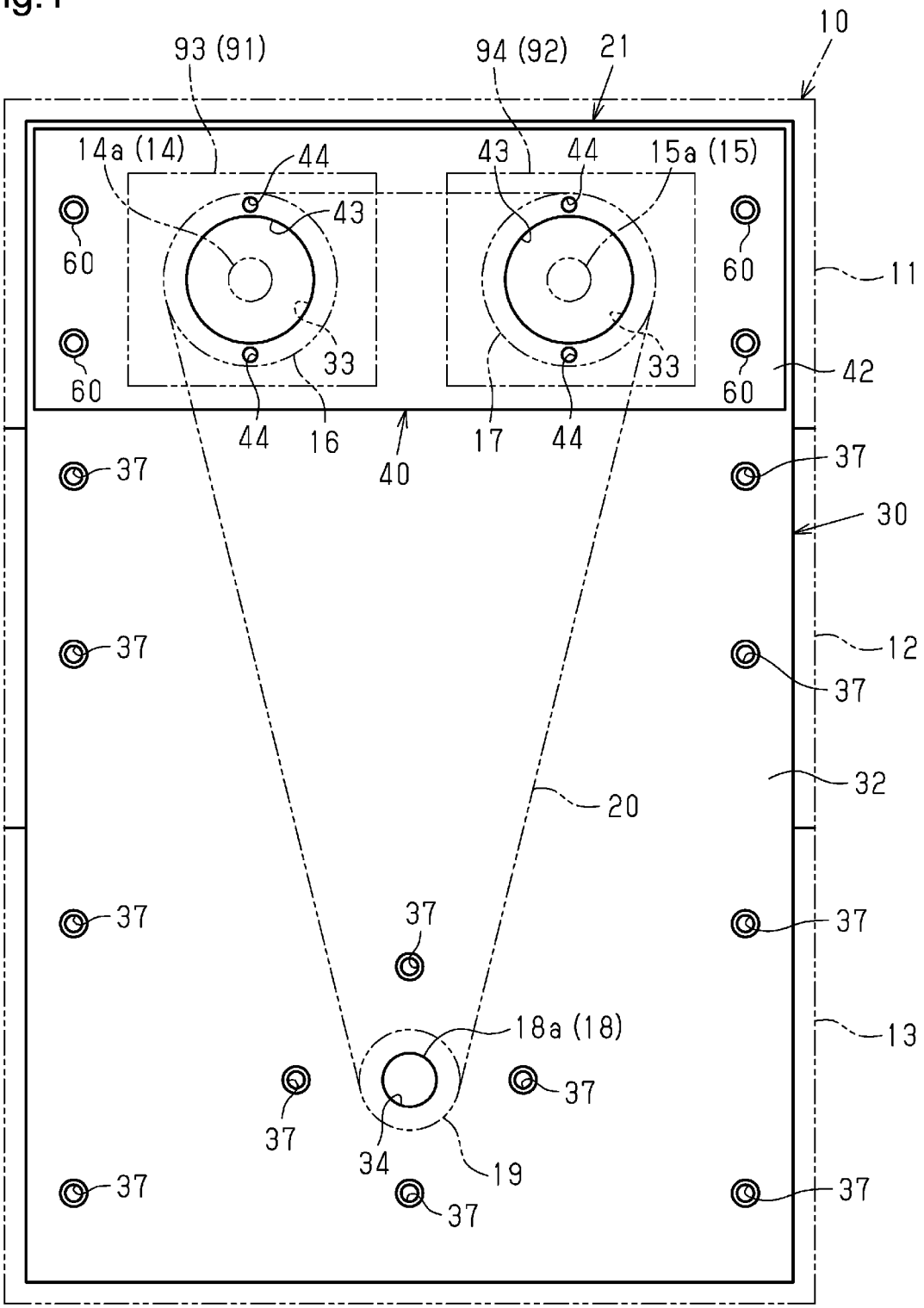
FIG. 1 is a front view of a chain cover for an internal combustion engine according to an embodiment, illustrating the chain cover attached to an engine main body.

As shown in FIG. 1, the internal combustion engine includes an engine main body 10 and a chain cover 21, which is attached to the engine main body 10.

Engine Main Body 10

As shown in FIG. 1, the engine main body 10 includes a cylinder head 11, a cylinder block 12, and a crankcase 13. The cylinder block 12 is disposed between the cylinder head 11 and the crankcase 13.

The cylinder head 11 rotatably supports an intake camshaft 14 and an exhaust camshaft 15.

The intake camshaft 14 and the exhaust camshaft 15 respectively open and close intake valves (not shown) and exhaust valves (not shown), which are engine valves.

The camshafts 14, 15 include ends 14*a*, 15*a* on one side in an extending direction of the camshafts 14, 15. The ends 14*a*, 15*a* protrude from the cylinder head 11.

Motor-driven variable valve timing mechanisms 91, 92 are respectively coupled to the ends 14*a*, 15*a* of the camshafts 14, 15.

The variable valve timing mechanisms 91, 92 respectively include motors 93, 94 and actuators (not shown), which include speed reduction mechanisms and link mechanisms.

The actuators of the variable valve timing mechanisms 91, 92 respectively include driven sprockets 16, 17.

As shown in FIG. 1, the crankcase 13 rotatably supports a crankshaft 18. The crankshaft 18 includes an end 18*a* in an extending direction of the crankshaft 18. The end 18*a* protrudes from the crankcase 13 in the same direction as the ends 14*a*, 15*a* of the camshafts 14, 15. A drive sprocket 19 is coupled to the end 18*a*.

A timing chain 20 is looped over the driven sprockets 16, 17 and the drive sprocket 19. The driven sprockets 16, 17 are configured to rotate in conjunction with rotation of the drive sprocket 19 by means of the timing chain 20. Rotational force of the crankshaft 18 is thus transmitted to the camshafts 14, 15.

The intake-side variable valve timing mechanism 91 controls the rotation speed of the motor 93 so as to vary the rotational phase of the intake camshaft 14 relative to the driven sprocket 16.

The exhaust-side variable valve timing mechanism 92 controls the rotation speed of the motor 94 so as to vary the rotational phase of the exhaust camshaft 15 relative to the driven sprocket 17.

Controllers (not shown) are respectively integrated with the motors 93, 94.

Chain Cover 21

As shown in FIG. 1, the chain cover 21 has a rectangular shape in front view. The chain cover 21 is attached to the side of the engine main body 10 from which the ends 14*a*, 15*a* of the camshafts 14, 15 and the end 18*a* of the crankshaft 18 protrude. The chain cover 21 is configured to cover the timing chain 20.

Figure 2:
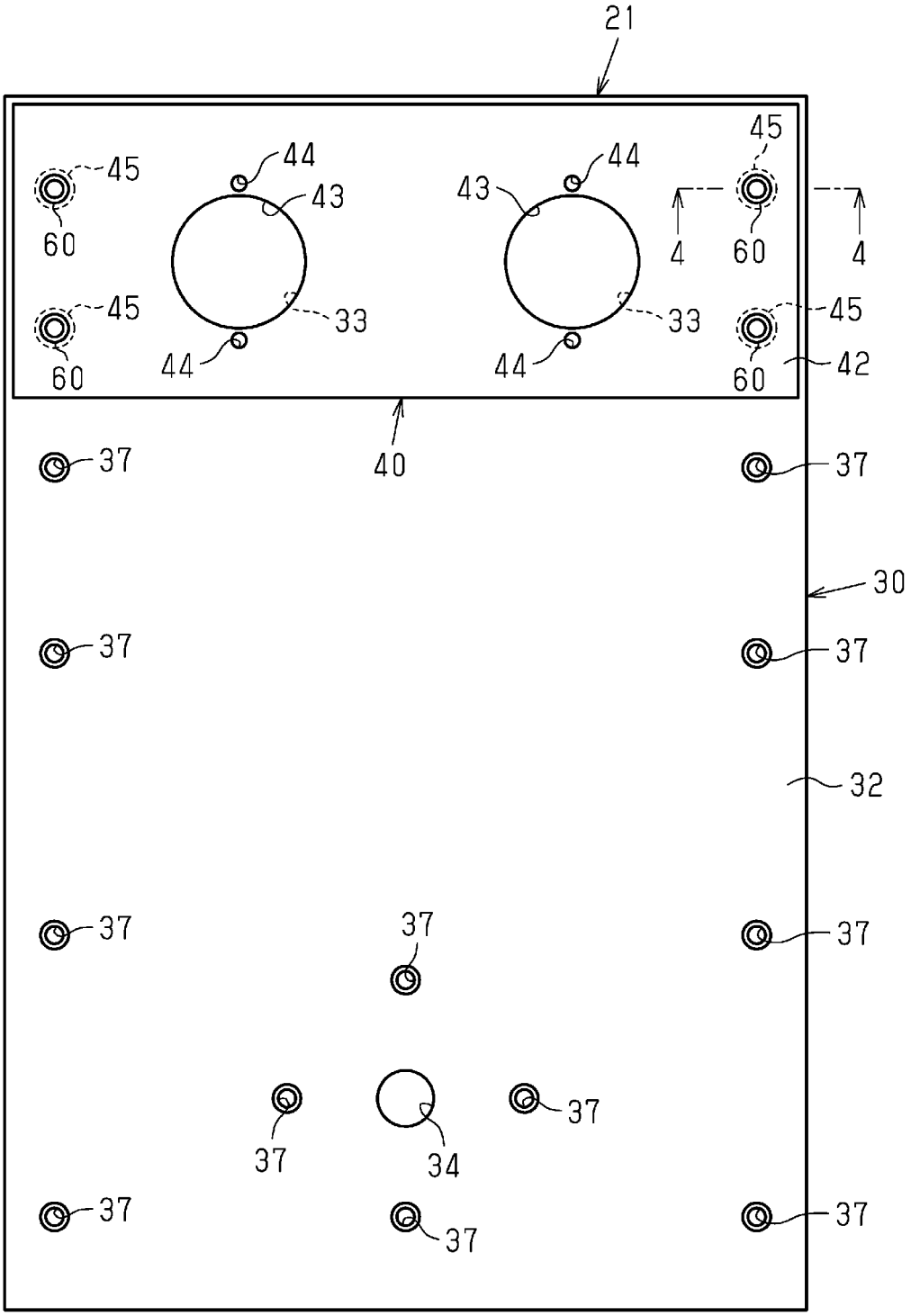
FIG. 2 is a front view of the chain cover according to the embodiment.
Figure 3:
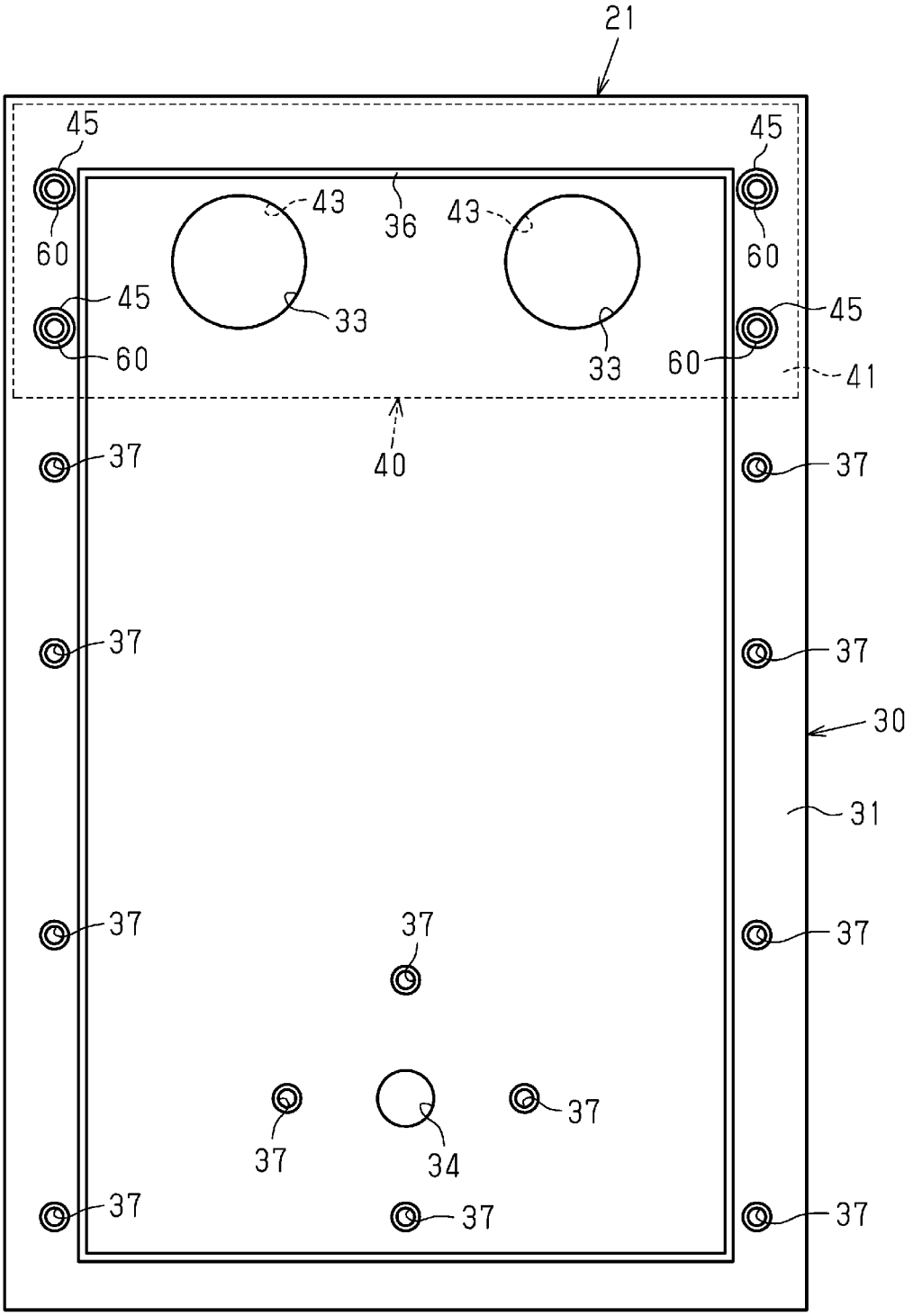
FIG. 3 is a rear view of the chain cover according to the embodiment.

As shown in FIGS. 1 to 3, the chain cover 21 includes a first member 30 and a second member 40, which is joined to the first member 30.

First, the first member 30 will be described.

As shown in FIGS. 2 and 3, the first member 30 has a rectangular shape in front view. The first member 30 includes a back face 31, which faces the engine main body 10, and a front face 32, which is located on a side opposite to the back face 31. The second member 40 is joined to the front face 32. The back face 31 corresponds to a facing surface according to the present disclosure.

The first member 30 includes two insertion holes 33, which respectively receive the motors 93, 94.

The first member 30 also includes a through-hole 34, through which the crankshaft 18 extends. The through-hole 34 is formed only in the first member 30.

Figure 4:
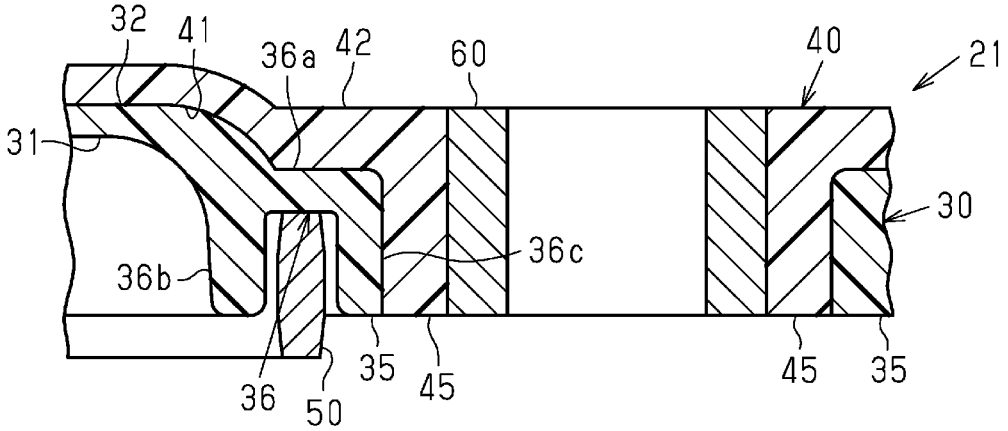
FIG. 4 is a cross-sectional view taken along line 4-4 of FIG. 2.

As shown in FIGS. 3 and 4, the back face 31 of the first member 30 includes a groove portion 36. A seal member 50 is fitted in the groove portion 36 to provide a seal between the first member 30 and the engine main body 10.

The groove portion 36 extends over an entire outer periphery of the back face 31. The groove portion 36 is formed only in the first member 30.

The groove portion 36 includes a bottom wall 36*a* and side walls 36*b*, 36*c*, which extend from opposite sides in the width direction of the bottom wall 36*a*.

The first member 30 is made of a hard plastic. In the present embodiment, the first member 30 is made of a plastic that has polyamide (PA-GF) as a major component.

The second member 40 will now be described.

As shown in FIGS. 1 to 3, the second member 40 has a rectangular shape in front view.

As shown in FIG. 4, the second member 40 includes a back face 41, which is joined to the first member 30, and a front face 42, which is located on a side opposite to the back face 41.

The second member 40 includes insertion holes 43, which respectively receive the motors 93, 94. The insertion holes 43 are continuous with the insertion holes 33 of the first member.

The motors 93, 94, with which the controllers are integrated, are attached to the front face 42 of the second member 40.

The second member 40 has attachment holes 44 in a peripheral portion around each insertion hole 43. Bolts (not shown) for attaching the motors 93, 94 to the second member 40 are threaded into the attachment holes 44. The attachment holes 44 correspond to attachment portions according to the present disclosure.

The second member 40 is made of a hard plastic that has a lower coefficient of linear expansion and a lower water absorbency than the hard plastic forming the first member 30. In the present embodiment, the second member 40 is made of polyphenylene sulfide (PPS-GF).

As shown in FIGS. 1 to 3, the chain cover 21 includes tubular collars 60, which receive bolts (not shown) for attaching the chain cover 21 to the engine main body 10.

As shown in FIGS. 3 and 4, the second member 40 is joined to the front face 32 of the first member 30. The second member 40 is formed by insert molding with the collars 60 as inserts. The second member 40 includes tubular portions 45, which respectively surround the collars 60.

As shown in FIGS. 1 to 3, each of the side sections in the width direction of the chain cover 21 is provided with two of the tubular portions 45 in the present embodiment.

As shown in FIG. 4, the first member 30 includes surrounding portions 35, which respectively surround the tubular portions 45. In the present embodiment, parts of the surrounding portions 35 form parts of the side wall 36*c* on the outer side of the groove portion 36.

As shown in FIGS. 1 to 3, the first member 30 has fastening holes 37 in portions that are not covered with the second member 40. Each fastening hole 37 receives a metal collar. Each of the side sections in the width direction of the chain cover 21 is provided with four of the fastening holes 37 in the present embodiment. Also, four of the fastening holes 37 are arranged around the through-hole 34. In FIG. 1, bolts inserted into the fastening holes 37 are omitted.

Operation of the present embodiment will now be described.

The chain cover 21 is obtained by forming the first member 30 by insert molding with the second member 40 as an insert. At this time, the groove portion 36, in which the seal member 50 is fitted, is formed only in the first member 30. With this configuration, the groove portion 36 includes no boundary between members, unlike a case in which the groove portion 36 extends across the first member 30 and the second member 40. This prevents the groove portion 36 from having a step on the inner surface.

The present embodiment has the following advantages.

(1) The chain cover 21 includes the first member 30, which is made of a hard plastic, and the second member 40, which is made of a material different from the hard plastic. The first member 30 includes the back face 31, which faces the engine main body 10. The second member 40 is joined to the first member 30. Only the back face 31 of the first member 30 includes the groove portion 36, which receives the seal member 50. The seal member 50 provides a seal between the first member 30 and the engine main body 10.

This configuration operates in the above-described manner. The close contact between the seal member 50 and the groove portion 36 is thus maintained.

(2) The second member 40 includes the insertion holes 43 and the attachment holes 44 arranged in the peripheral portion around each insertion hole 43. The insertion holes 43 receive the variable valve timing mechanisms 91, 92 coupled to the camshafts 14, 15. More specifically, the insertion holes 43 receive the motors 93, 94 of the variable valve timing mechanisms 91, 92. The variable valve timing mechanisms 91, 92, more specifically, the motors 93, 94 of the variable valve timing mechanisms 91, 92, are attached to the attachment holes 44. The second member 40 is made of PPS-GF, which satisfies both the condition that a coefficient of linear expansion is lower than that of PA6-GF and the condition that the water absorbency is lower than that of the hard plastic.

In the chain cover 21, the motors 93, 94 are attached to the attachment holes 44, which are provided in the peripheral portions around the insertion holes 43, into which the motors 93, 94 are inserted. To ensure the positional accuracy of the motors 93, 94, the attachment holes 44 are desired to have material properties that resist deformation due to heat transmitted from the engine main body 10 and collected water.

With the above-described configuration, the second member 40, which includes the attachment holes 44, is made of a material that satisfies both the condition that the coefficient of linear expansion is lower than that of the hard plastic forming the first member 30 and the condition that the water absorbency is lower than that of the hard plastic. This limits deformation of the attachment holes 44 due to heat transmitted from the engine main body 10 and collected water. This prevents the positional accuracy of the motors 93, 94 attached to the attachment holes 44 from decreasing.

(3) Only the first member 30 includes the through-hole 34, through which the crankshaft 18 extends.

This configuration reduces the size of the second member 40 as compared to a configuration in which the second member 40 includes a through-hole through which the crankshaft 18 extends, in addition to the insertion holes 43, into which the motors 93, 94 are inserted, and the attachment holes 44, to which the motors 93, 94 are attached. Accordingly, the size and the weight of the chain cover 21 are reduced.

(4) The first member 30 is formed by insert molding with the second member 40 as an insert.

In this type of configuration, if the groove portion 36 were to be extended across the first member 30 and the second member 40, then steps would be likely to form at boundaries between members in the groove portion 36.

If the present disclosure is applied to this type of configuration, the close contact between the seal member 50 and the groove portion 36 is maintained.

(5) The chain cover 21 includes the tubular collars 60, which receive bolts for attaching the chain cover 21 to the engine main body 10. The second member 40 is joined to the front face 32 of the first member 30, which is on the side opposite to the back face 31. The second member 40 is formed by insert molding with the collars 60 as inserts and includes the tubular portions 45 respectively surrounding the collars 60. The first member 30 includes the surrounding portions 35, which respectively surround the tubular portions 45.

With this configuration, the tubular portions 45 of the second member 40, which respectively surround the collars 60, are respectively surrounded by the surrounding portions 35 of the first member 30. The chain cover 21 is attached to the engine main body 10 with the bolts inserted into the collars 60. Accordingly, the first member 30 and the second member 40 are fixed to each other at the tubular portions 45 and the surrounding portions 35 in addition to the joining portions. This limits deformation of the first member 30 due to heat transmitted from the engine main body 10 and collected water, and thus limits deformation of the second member 40 effectively.

<Modifications>

The present embodiment may be modified as follows. The present embodiment and the following modifications can be combined as long as the combined modifications remain technically consistent with each other.

The number and the positions of the fastening holes 37 are not limited to the ones in the above-described embodiment, but may be changed.

The numbers and the positions of the tubular portions 45 of the second member 40 and the surrounding portions 35 of the first member 30 are not limited to the ones in the above-described embodiment, but may be changed.

The tubular portions 45 of the second member 40 and the surrounding portions 35 of the first member 30 may be omitted all together.

The first member 30 does not necessarily need to be formed by insert molding with the second member 40 as an insert. That is, the chain cover 21 may be formed by joining separately molded first member 30 and second member 40 to each other.

The chain cover 21 is not limited to the one in which only the first member 30 includes the through-hole 34. For example, the second member 40 may include a hole through which the crankshaft 18 extends, so that this hole and the through-hole 34 form a through-hole in the chain cover 21, through which the crankshaft 18 extends.

The variable valve timing mechanisms 91, 92 are not limited to electric type with the motors 93, 94 as described in the above-described embodiment, but may be a hydraulic type.

The second member 40 is not limited to the one made of polyphenylene sulfide (PPS-GF) as described in the above-described embodiment, but may be made of metal such as aluminum in place of PPS. In place of PPS, it is possible to select and use any of the following hard plastics: liquid crystal polymer (LCP), polyether ether ketone (PEEK), polyethylene naphthalate (PEN), polyamide 6T (PA6T), polyamide 9T (PA9T), polyethylene terephthalate (PBT), or polyacetal (POM).

The first member 30 is not limited to the one made of polyamide 6 (PA6-GF) as described in the above-described embodiment, but may be made of a plastic that has polyamide as a major component in place of polyamide 6.

The groove portion 36 does not necessarily need to be provided over the entire outer periphery of the first member 30 as described in the above-described embodiment, but may include ends in the extending direction.

The shapes of the chain cover 21, the first member 30, and the second member 40 are not limited to rectangular shapes in front view as described in the above-described embodiment, but may be changed in accordance with requirements to be met by the chain cover 21 when mounted on the engine main body 10.

The cover according to the present disclosure is not limited to the chain cover 21, but may be a timing belt cover.

What is claimed is:

1. A cover for an internal combustion engine, the cover being attachable to an engine main body and covering a timing chain or a timing belt, the cover comprising:

a first member that includes a facing surface, the facing surface facing the engine main body; and a second member that is made of a material different from the first member and is joined to the first member, wherein a groove portion is provided only in the facing surface of the first member, a seal member is fitted in the groove portion to provide a seal between the first member and the engine main body, the second member is plastic and includes:

an insertion hole that receives an engine valve operation mechanism that is coupled to a camshaft; and an attachment portion provided in a peripheral portion around the insertion hole, the engine valve operation mechanism being attached to the attachment portion, and the second member is made of a material that satisfies at least one of a condition that a coefficient of linear expansion is lower than that of the first member or a condition that a water absorbency is lower than that of the first member.

2. A cover for an internal combustion engine, the cover being attachable to an engine main body and covering a timing chain or a timing belt, the cover comprising:

a first member that includes a facing surface, the facing surface facing the engine main body; and a second member that is made of a material different from the first member and is joined to the first member, wherein a groove portion is provided only in the facing surface of the first member, a seal member is fitted in the groove portion to provide a seal between the first member and the engine main body, the second member includes:

an insertion hole that receives an engine valve operation mechanism that is coupled to a camshaft; and an attachment portion provided in a peripheral portion around the insertion hole, the engine valve operation mechanism being attached to the attachment portion, the second member is made of a material that satisfies at least one of a condition that a coefficient of linear expansion is lower than that of the first member or a condition that a water absorbency is lower than that of the first member, and only the first member includes a through-hole through which a crankshaft extends.

3. The cover for the internal combustion engine according to claim 1, wherein the first member is insert molded with the second member as an insert.

4. A cover for an internal combustion engine, the cover being attachable to an engine main body and covering a timing chain or a timing belt, the cover comprising:

a first member that includes a facing surface, the facing surface facing the engine main body; and a second member that is made of a material different from the first member and is joined to the first member, wherein a groove portion is provided only in the facing surface of the first member, a seal member is fitted in the groove portion to provide a seal between the first member and the engine main body, the cover includes tubular collars, the collars being configured to receive bolts for attaching the cover to the engine main body, the second member is joined to a face of the first member that is on a side opposite to the facing surface, the second member is insert molded with the collars as inserts, and includes tubular portions respectively surrounding the collars, the tubular portions contact outer surfaces of the collars along an entire axial length of the collars, and the first member includes surrounding portions, the surrounding portions respectively surrounding the tubular portions.

5. The cover for the internal combustion engine according to claim 1, wherein the first material is a plastic including a polyamide.

* * * * *